US005416996A

United States Patent [19]

Clemens et al.

[11] Patent Number: 5,416,996

[45] Date of Patent: May 23, 1995

[54] DISPLAY APPARATUS

[76] Inventors: Richard Clemens, 2700 Nielson Way, #533, Santa Monica, Calif. 90405; Thomas Ranftl, 1250 Durant Ct., Walnut Creek, Calif. 94596; Kevin Lee, 23696 Cora, Farmington Hills, Mich. 48336

[21] Appl. No.: 33,141

[22] Filed: Mar. 16, 1993

[51] Int. Cl.[6] ..... G09F 13/00

[52] U.S. Cl. ..... 40/502; 40/505

[58] Field of Search ..... 40/502, 503, 504, 505, 40/506, 480

[56] References Cited

U.S. PATENT DOCUMENTS

| | | | |
|---|---|---|---|
| 1,706,386 | 3/1929 | Killmnick | 40/502 |
| 3,273,271 | 9/1966 | Werner | 40/502 |
| 3,304,638 | 2/1967 | Grandell | 40/505 |
| 3,367,049 | 2/1968 | Noreen | 40/505 |
| 3,383,785 | 5/1968 | Werner | 40/505 |
| 3,826,027 | 7/1974 | Abbema | 40/505 X |
| 3,921,321 | 11/1975 | Weisskopf . | |
| 4,002,022 | 1/1977 | Lopez . | |
| 4,189,859 | 2/1980 | Ahlgren | 40/505 |
| 4,381,616 | 5/1983 | Saxer . | |
| 4,528,763 | 7/1985 | Ahlgren . | |

OTHER PUBLICATIONS

Product Sheet and drawings of Graphic Revolutions ®, by Clearr Corporation

*Primary Examiner*—Brian K. Green

*Attorney, Agent, or Firm*—Fliesler, Dubb, Meyer & Lovejoy

[57] ABSTRACT

A display apparatus for showing a number of different display images. The apparatus includes a housing and a plurality of triangular display elements mounted therein. Each of the display elements includes a first, second and third major sides, and is suspended for rotation about an axis, the axes of rotation of the elements arranged in a plane. Each of the first, second and third major sides each have a first and second edge, the first and second edge including a slide panel for inserting a display segment therein. The apparatus also includes a vertical blind track for mounting the plurality of elements, and a motor coupled to the vertical blind track for powering rotation of the elements. Also provided is a plurality of illumination sources, one of said plurality associated with each of said plurality of display elements, mounted at the base of each of said elements.

17 Claims, 7 Drawing Sheets

DISPLAY APPARATUS

BACKGROUND OF THE INVENTION

1. Field of the Invention

The invention relates to display technology. More specifically, the invention relates to signs having multiple, alternating, display screens.

2. Description of the Prior Art

Electromechanical signs having the ability to present display at least two or more images through means of a number of sequentially rotating elements sign are generally well known. Examples of such signs are shown in U.S. Pat. Nos. 4,528,763, 4,002,022, and 3,921,321.

Each of the aforementioned signs includes a number of tri-lateral display elements, with each side of the element provided with a portion of an image that is displayed when all element sides having portions of the image are turned outwardly at the same time. The elements are continuously or intermittently rotated so that second and third sides of each display element yield second and third images for display.

Each of the aforementioned patents deals with particular problems and solutions of providing such signs. For example, U.S. Pat. No. 4,528,763 ('763) deals with provision of trilateral screen assemblies and a system for easily providing the tri-lateral assembly onto holding assemblies for rotation. U.S. Pat. No. 4,002,022 ('022) illustrates various mechanisms for rotating tri-lateral elements in such a sign. U.S. Pat. No. 3,921,321 ('321) illustrates a mechanism for intermittent rotation comprising a Maltese cross and gear arrangement.

The '022 and '321 patents illustrate rather cumbersome means for rotating the display elements. In order to increase reliability and decrease manufacturing costs, the more basic the mechanism utilized to rotate such constituent elements, the more cost effective such sign will be to manufacture.

Another important feature provided in certain signs of this type is illumination of the display elements. Such illumination may comprise a light source directed at the face of the display or backlighting of the elements through transparent or semi-transparent display images. Shown in U.S. Pat. No. 4,381,616, is a light source comprising a fluorescent tube positioned within each of the tri-lateral display elements, which rotates or remains stationary with the element and is co-axial the axis of rotation of the display element. The '616 patent emphasizes provision of opaque edge members on each of the panels to prevent the light source from degrading the quality of the display image. However, in a system such as shown in the '616 patent, the light sources are difficult to replace. In particular, the display elements must be removed from their mounting and the light source slid out of the element.

A second sign system of this type is the Graphic Revolutions® sequential-image transparency illuminator, manufactured by Clearr Corporation, Minneapolis, Minn. The Graphic Revolutions® provides a back-lit display unit requiring display images comprised of transparencies to be affixed to the sides of the display elements, and utilizes 5,000° Kelvin, color correct lamps for illumination of the transparencies. The advantage of such fluorescent lamps is that they provide an even illumination over the entire vertical and horizontal surface area of the sign. However, as noted above, such lamps are rather difficult to replace. In addition, the Clearr Corporation sign utilizes special transparencies manufactured from a translucent acrylic material affixed to the rotatable elements, which can increase the cost of use for the sign.

SUMMARY OF THE INVENTION

Thus, the object of the invention is to provide a electromechanical display apparatus utilizing a plurality of display elements which rotate to display various images.

A further object of the invention is to provide a display apparatus which includes a means for illumination of the display image in a manner which is even over the surface of the image.

A further object of the invention is to provide such illumination with an illumination source which is easily replaced when defective.

Yet another object of the invention is to provide a drive mechanism which is both reliable and easy to manufacture.

These and other objects of the invention are provided in a display apparatus capable of showing a number of different display images. The apparatus includes a housing and a plurality of triangular display elements mounted therein. Each of the display elements includes a first, second and third major sides, and is suspended for rotation about an of axis, the axes of the elements arranged in a plane. Each of the first, second and third major sides each have a first and second edge, the first and second edge including a slide panel for inserting a display segment therein. The apparatus also includes a vertical blind track for mounting the plurality of elements, and a motor coupled to the vertical blind track for powering rotation of the elements. Also provided is a plurality of illumination sources, one of said plurality associated with each of said plurality of display elements, mounted at the base of each of said elements.

DESCRIPTION OF THE PREFERRED EMBODIMENT

Figure 1A:
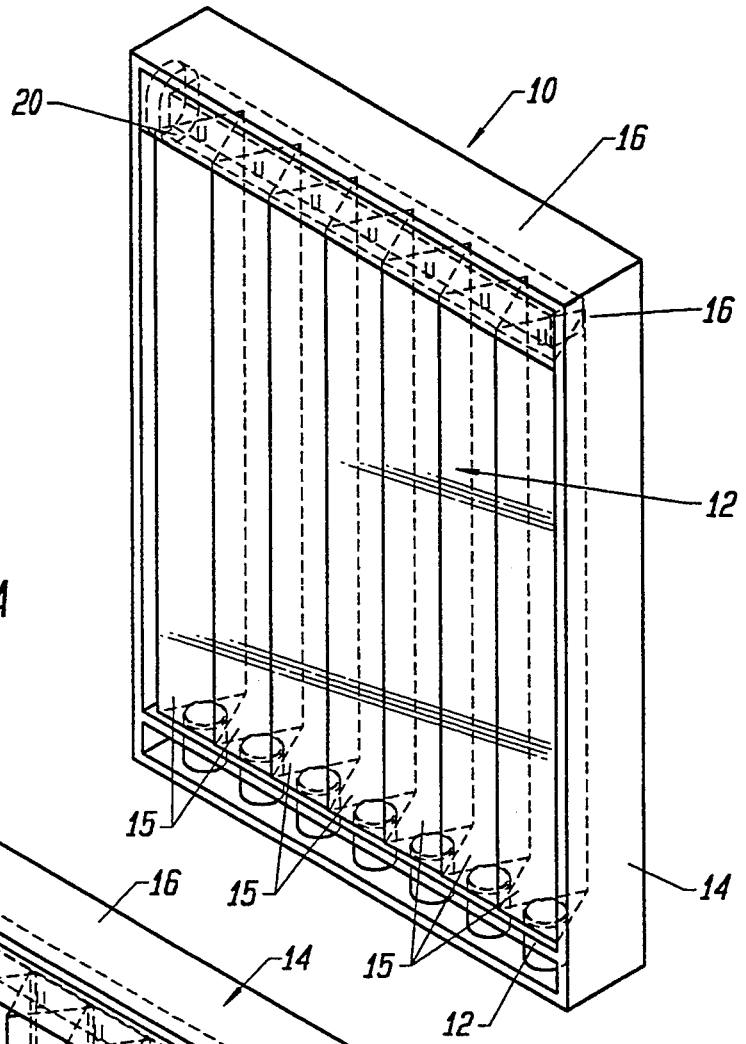
FIGS. 1A–1B are perspective views of the display apparatus of the present invention.
Figure 1B:
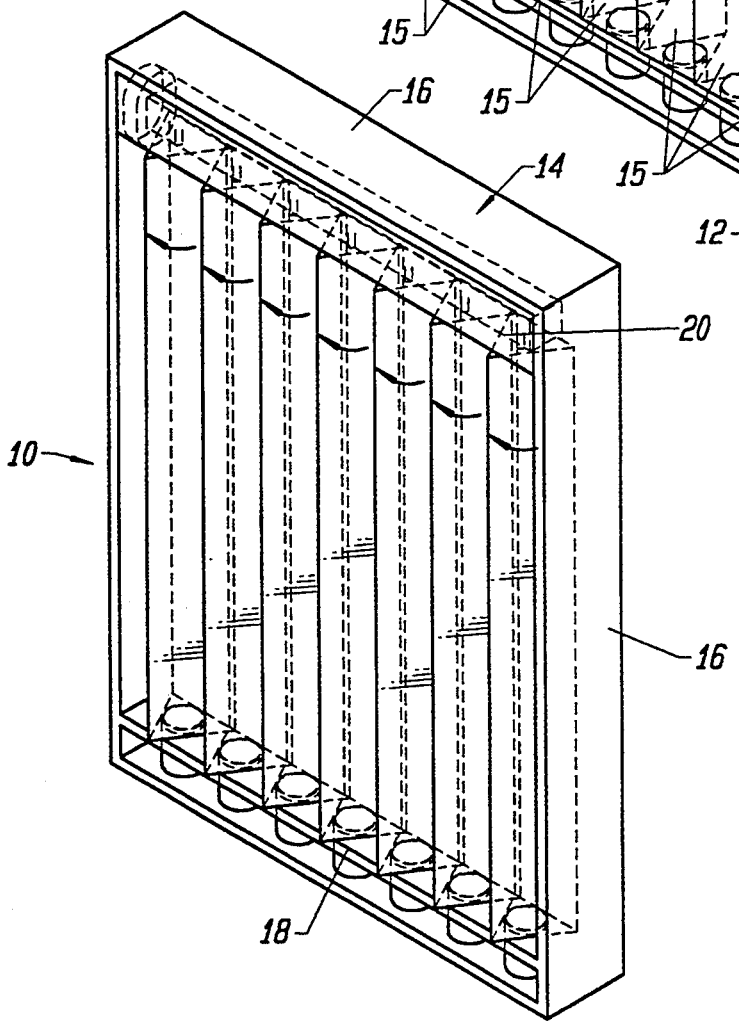

A display apparatus 10 in accordance with the present invention is shown in FIGS. 1–6. Apparatus 10 includes a number of rotatable display elements 15 which, as shown in FIG. 1A, form a plane 12 for displaying a display image. As shown in FIG. 1B, display elements 15 synchronously rotate to display different display images as alternate sides of each of the display elements form plane 12. Display elements 15 are mounted in a housing 14 which may be comprised of a pressboard material or extruded aluminum. Housing 14 includes an outer frame 16, a base cross-beam 18, and a drive cover panel 20. In FIG. 1B, display elements 15 are shown as rotating in a clockwise direction; it should be generally understood that they may also rotate in a counterclockwise direction.

Figure 2:
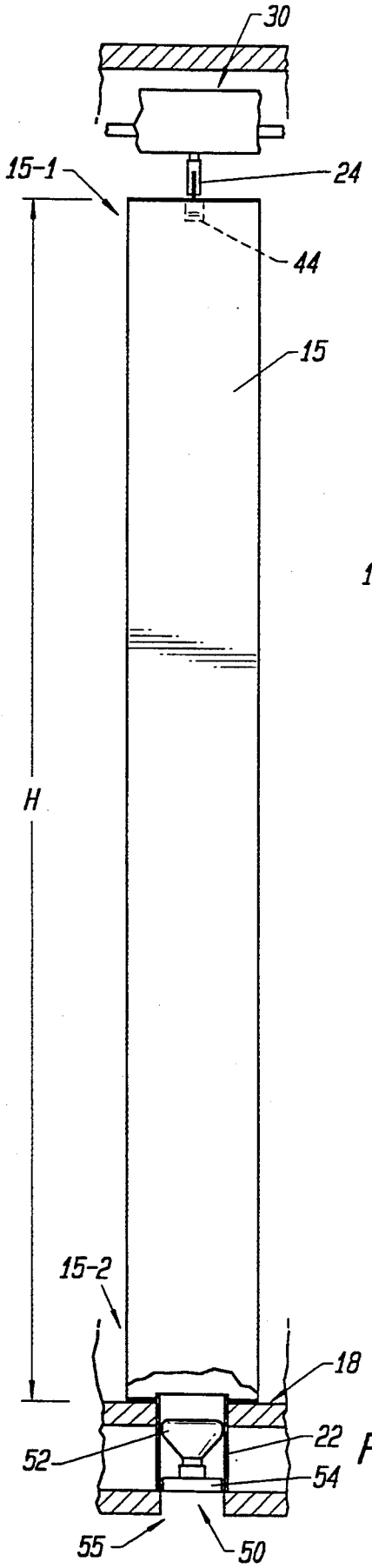
FIG. 2 is a side view of an individual display element mounted in a portion of the housing of the display apparatus.
Figure 5:
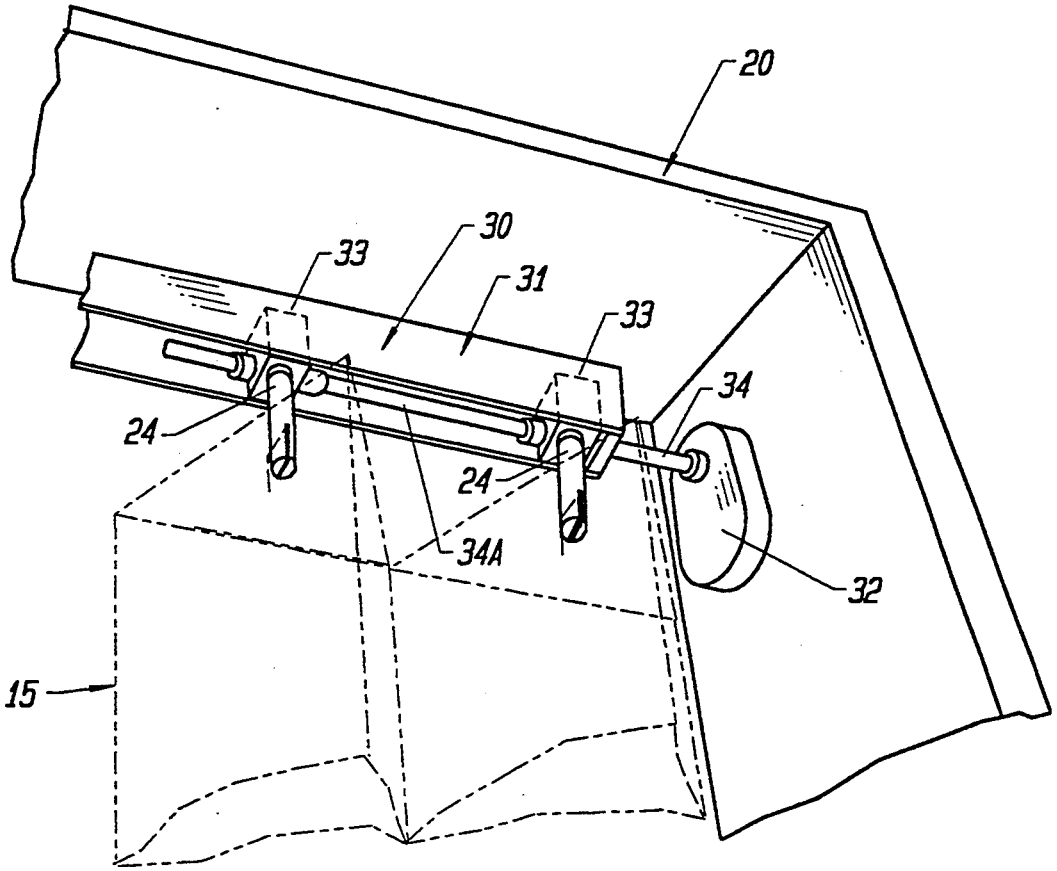
FIG. 5 is a perspective view of a portion of the drive structure of the present invention.

As shown in FIGS. 2 and 5, each display element 15 is coupled to a portion of drive assembly 30 by a slotted hook 24 which receives a notched member coupled to a top cap (described below) provided in element 15. Element 15 is thereby suspended from the drive assembly 30.

Figure 3A:
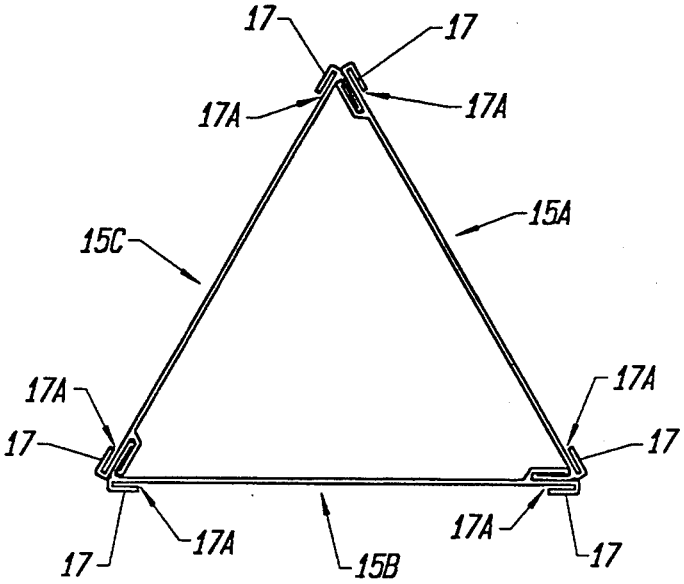
FIG. 3A is a top, cross-sectional view of three interlocking members making up a display element for use in the display apparatus of the present invention.
Figure 3B:
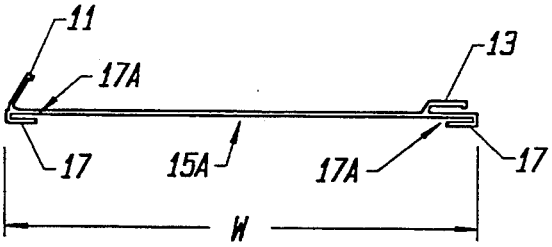
FIG. 3B is a top view of one interlocking side member for use in the display apparatus of the present invention.

In one embodiment, each element 15 includes three display side members 15*a*, 15*b*, and 15 *c* as shown in FIG. 3A. Each side member comprises an independent interlocking vane having a height 14 (shown in FIG. 2) and a width W, as shown in FIG. 3B. Each side member 15*a*–15 *c* may be manufactured from an extruded plastic to have flanges 17 defining slots 17*a* so that a portion of the display image to be presented on plane 12 may be inserted thereinbetween. For example, apparatus 10 is particularly suited for displaying poster size prints. A poster-size print would be cut into as many segments of equal width as there are display elements, and each segment placed between flanges 17 of the respective display elements 15, for example, on sides 15*a*. In FIG. 1, the display elements 15 have a width of approximately 3½" and seven elements are utilized; in FIG. 8 the display elements have a width of approximately 4" and only six elements are required.

Each member 15*a*–15 *c* also includes a snap coupling assembly to allow the members to be coupled together to form tri-lateral element 15. A beaded segment 11 and retainer 13, into which beaded segment 11 may be inserted and retained, are provided at opposite sides of members 15*a*–15 *c*. It should be understood that beaded segment 11 and retainer 13 run the length of display element 15.

Figure 4A:
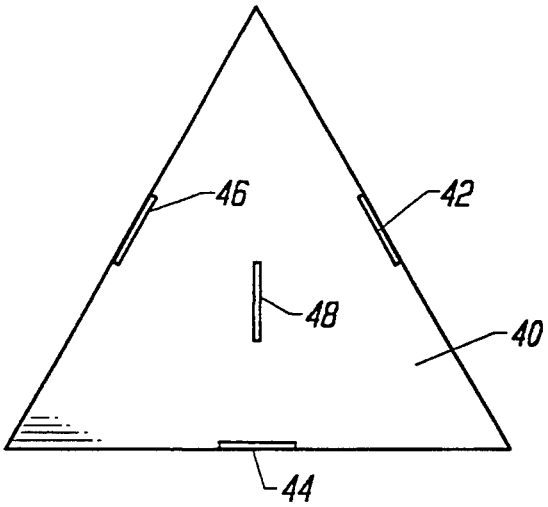
FIGS 4A and 4B are top and side views, respectively, of the top cap for the interlocking members of the display element of the present invention.
Figure 4B:
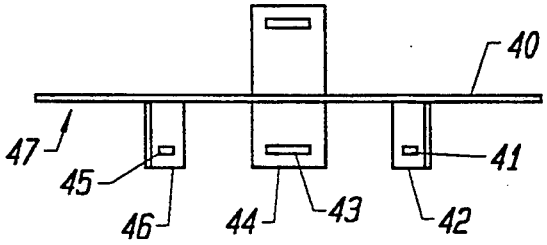

The assembled side members 15*a*, 15*b*, 15 *c*, are coupled to a top cap 40 (shown in FIGS. 4A and 4B) and a bottom cap 60 (shown in FIGS. 4C and 4D) which provide structural rigidity to element 15 and enable display element 15 to be coupled to the drive assembly 30. Shown in FIG. 4A is a top view of top cap 40 for coupling the display members 15 to the drive apparatus 30. Shown in FIG. 4B is a side view of top cap 40. Top cap 40 includes three mounting posts 42, 44 and 46 for securing side members 15*a*, 15*b* and 15 *c*, respectively, to top cap 40. Horizontally oriented mounting slots 41, 43 and 45 may be provided in posts 42, 44 and 46, respectively, to allow top cap 40 to be secured to each interlocking member 15*a*, 15*b*, 15 *c* of the element 15. Mounting post 48 extends upwardly from the center of top cap 40 and couples to slotted hook 24 of one portion of drive assembly 30. Top cap 40 is generally manufactured of white or clear plastic, such as Lexan. The lower side 47 of top cap 40 may generally be manufactured to be reflective to act in conjunction with the light source 50 provided at the base of element 15 to provide even illumination of the display member. White plastic achieves such reflection or a silver insert (not shown) may be provided.

Figure 4C:
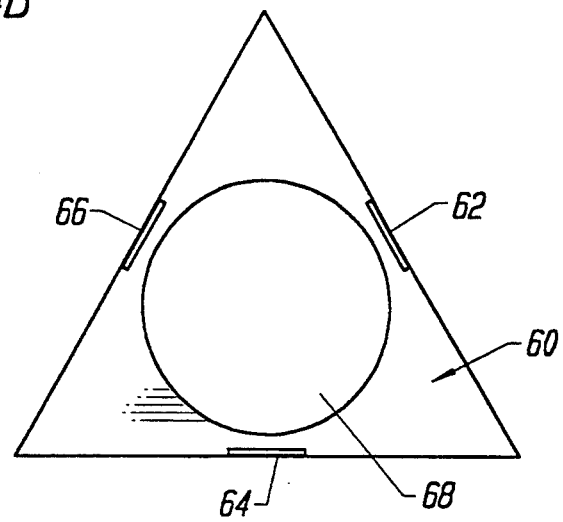
FIGS. 4C and 4D are top and side views, respectively, of the bottom cap for securing the interlocking members of the display element of the present invention.
Figure 4D:
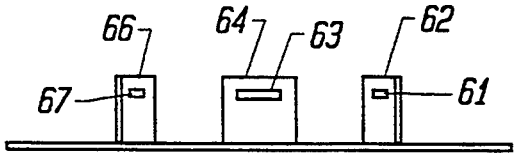

Bottom cap 60 is secured at the bottom end 15-2 of element 15 and is shown in FIGS. 4C and 4D. Bottom cap 60 is similar in structure to top cap 40, and includes mounting posts 62, 64, and 66, with corresponding horizontally oriented slots 61, 63, 67, to allow bottom cap 60 to be secured to sides 15*a*, 15*b*, and 15 *c*, respectively. Hole 68 is provided in bottom cap 60 to allow the lower end 15-2 of assembled display element 15 to be slipped over post 22. The diameter "D" of bore 68 is slightly larger than the diameter of post 22 to allow element 15 to rotate thereabout. One post 22 is provided for each display element 15.

Post 22 houses a light source 50 comprising a halogen lamp 52 and a power coupling 64. Halogen lamp 52 and coupling 54 are seated in post 22 and direct light toward the top portion 15-1 of display element 15. The use of a small illumination source at the base of each of the display elements makes replacement of the light sources extremely easy when the bulb's useful life expires. Furthermore, the use of a halogen light source was determined by the inventors of the present invention to comprise the optimal light source for this type of display apparatus. In particular, the halogen lamp is easy to replace, and provides an intense beam of illumination over the length of the display element with acceptable heat emission and power consumption. Bulbs 52 may be accessed directly through bores 55 in the base of outer frame 16 of housing 20. In this regard, coupling 54 may be designed to be easily removed from and secured in tube 22. Light bulb 52 is generally comprised of an MR11 20 W halogen narrow spotlight, having a diameter of 1⅜" and a height of 1". As should be well understood, standard ballasts are required to convert standard AC line voltage of 110–120 v AC to the 12 v DC required for bulbs 52.

FIG. 5 is a depiction of the drive assembly 30 for use in accordance with the present invention. Drive assembly 30 generally comprises a vertical blind track-type overhead assembly, such as the type manufactured in LouverDrape, Santa Monica, Calif. Such a drive includes a track housing channel 31 in which individualized gear boxes 33 are provided. Each gear box 33 comprises a spur and worm gear provided in an outer housing as shown in FIG. 5. The gears and housing are generally made from a durable plastic such as Delrin ®. Slotted hooks 24 extend downwardly from gear boxes 33. Drive assembly 30 includes a motor 32 coupled at one end of housing 20. An output shaft 34 is coupled to motor 32 and to drive assembly 30. Each of the gear boxes 33 is coupled by intermittent shafts 34*a*. In this manner, rotation of the motor 32 drives gear boxes 33 to synchronously rotate all display elements 15. It should be understood that motor 32 may be replaced or supplemented by a manual rotation knob coupled to shaft 34.

Figure 6:
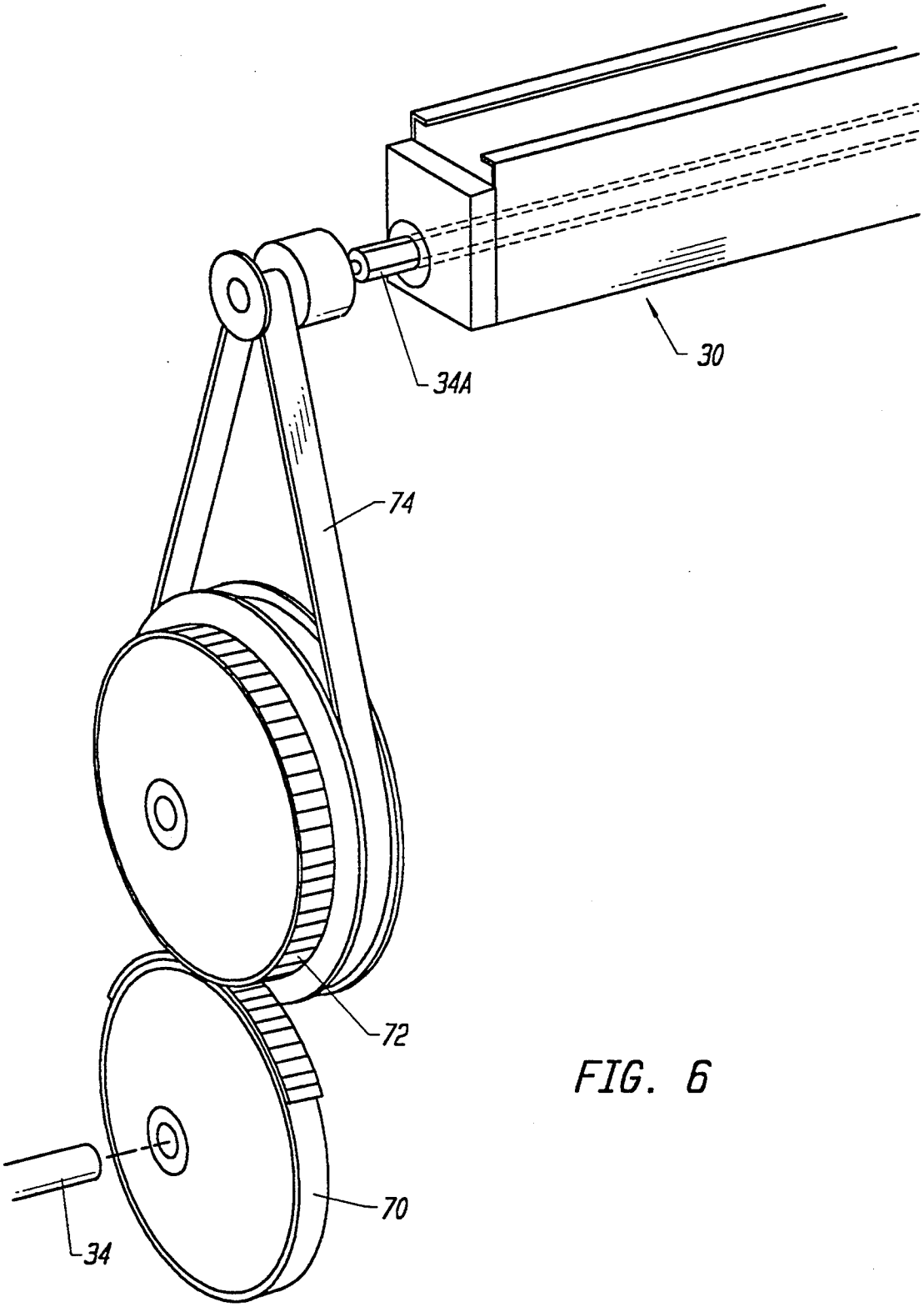
FIG. 6 is a representation of a gear and belt arrangement for providing intermittent motion for the display elements.

Further, it is possible to provide either continuous or intermittent motion of the display elements. As shown in FIG. 6, an intermittent motion gear may be provided between motor 32 and output shaft 34, and drive assembly 30 to provide this "start-stop" effect. In a three-side embodiment, 120° rotation of each element would be required before each stop. To implement such an embodiment an intermittent gear, for example, a 60-tooth sprocket 70 with 40 of said teeth removed, may be mounted to the output shaft 34 of the motor 32 while a conventional sprocket 72 of matching size with a complete set of 60 may be positioned for interaction therewith. As the intermittent sprocket rotates, the teeth thereof will engage the gear coupled to the vertical blind head rail every 240°. Other alternatives for providing such intermittent motion are well known and may be implemented in the context of the present invention.

FIG. 6 also shows a V-groove timing belt 74 utilized with sprocket 72 to provide a 10:1 gear ratio between output shaft 34 and gear boxes 33. This timing arrangement may be utilized to offset the 1:10 ratio between the spur and worm gears conventionally used in gear boxes 33.

Figure 7B:
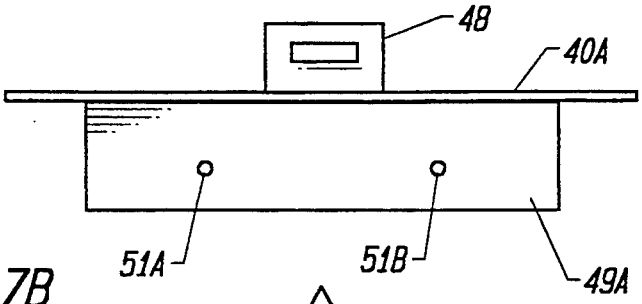
FIGS. 7A–7B are top and side views of an alternative embodiment of the top cap for use in securing the display elements of the present invention.
Figure 7A:
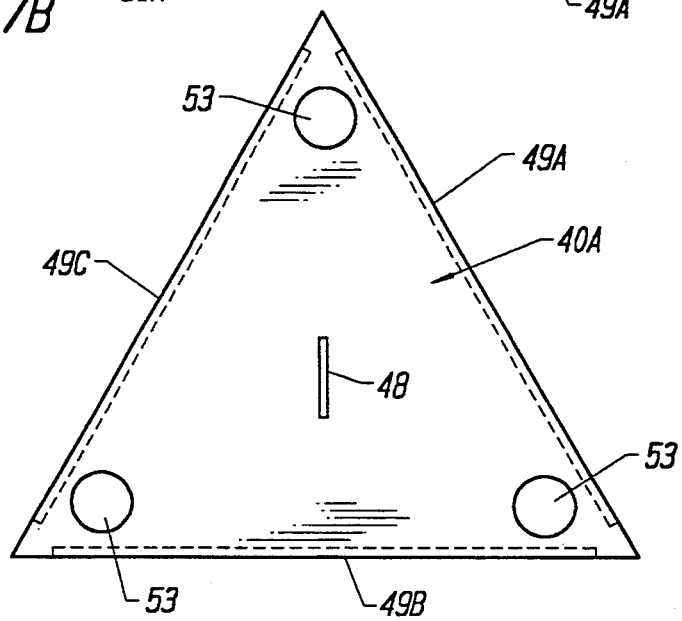

Shown in FIGS. 7A and 7B is a second embodiment of a top cap 40*a* for use in the present invention. Top cap 40*a* includes a top post 48 and downward facing flanges 49*a*, 49*b*, 49*c* which allow top cap 40*a* to be secured to the element sides 15*a*, 15*b*, 15 *c*. Top cap 40*a* also includes three vent holes 53 to allow any heat generated by light source 50 to evacuate from element 15.

Figure 7C:
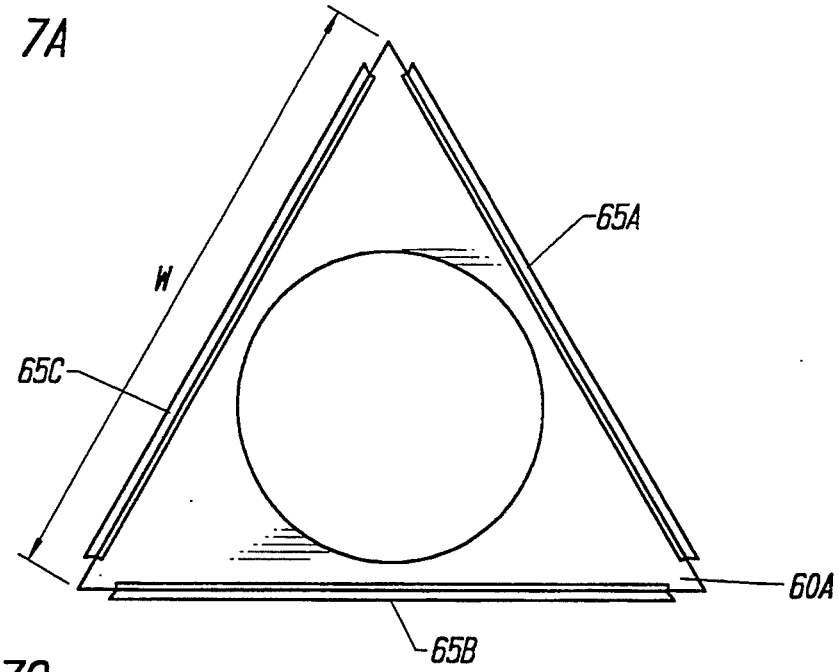
FIGS. 7C–7D are top and side views of an alternative embodiment of the bottom cap for use in securing the display elements of the present invention.
Figure 7D:
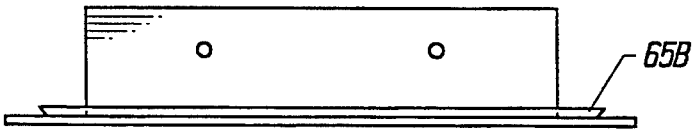

FIGS. 7C and 7D are a top view of an alternative embodiment of the bottom cap 60*a*. Bottom cap 60*a* includes capture flanges 65*a*, 65*b*, and 65*c* which act to retain a portion of the display material inserted between flanges 17 of each interlocking member 15*a*, 15*b* and 15 *c*. The flanges 65*a*–65*c* are typically 3/32 inches in height and angled outwardly from the center of bottom cap 60*a* so when a portion of the display material is inserted between flanges 17, it is retained from slipping out of display member 15 by flanges 65*a*–65*c*.

In one embodiment, suitable for use with poster-size print material, triangular elements have a width W of approximately 4", a height of 38" and are spaced apart in housing 20 by approximately $\frac{1}{8}$". This allows the elements 15 to revolve without interference. Thickness of the top and bottom caps is approximately 0.08". In such an embodiment, partially shown in FIG. 8, six display elements 15 are utilized. It should be understood that the size of the apparatus may vary in accordance with the desired application. Poster size prints are particularly well suited since such prints are generally printed on conventional magazine-stock and allow sufficient light to pass therethrough for backlighting of the display image.

Figure 8:
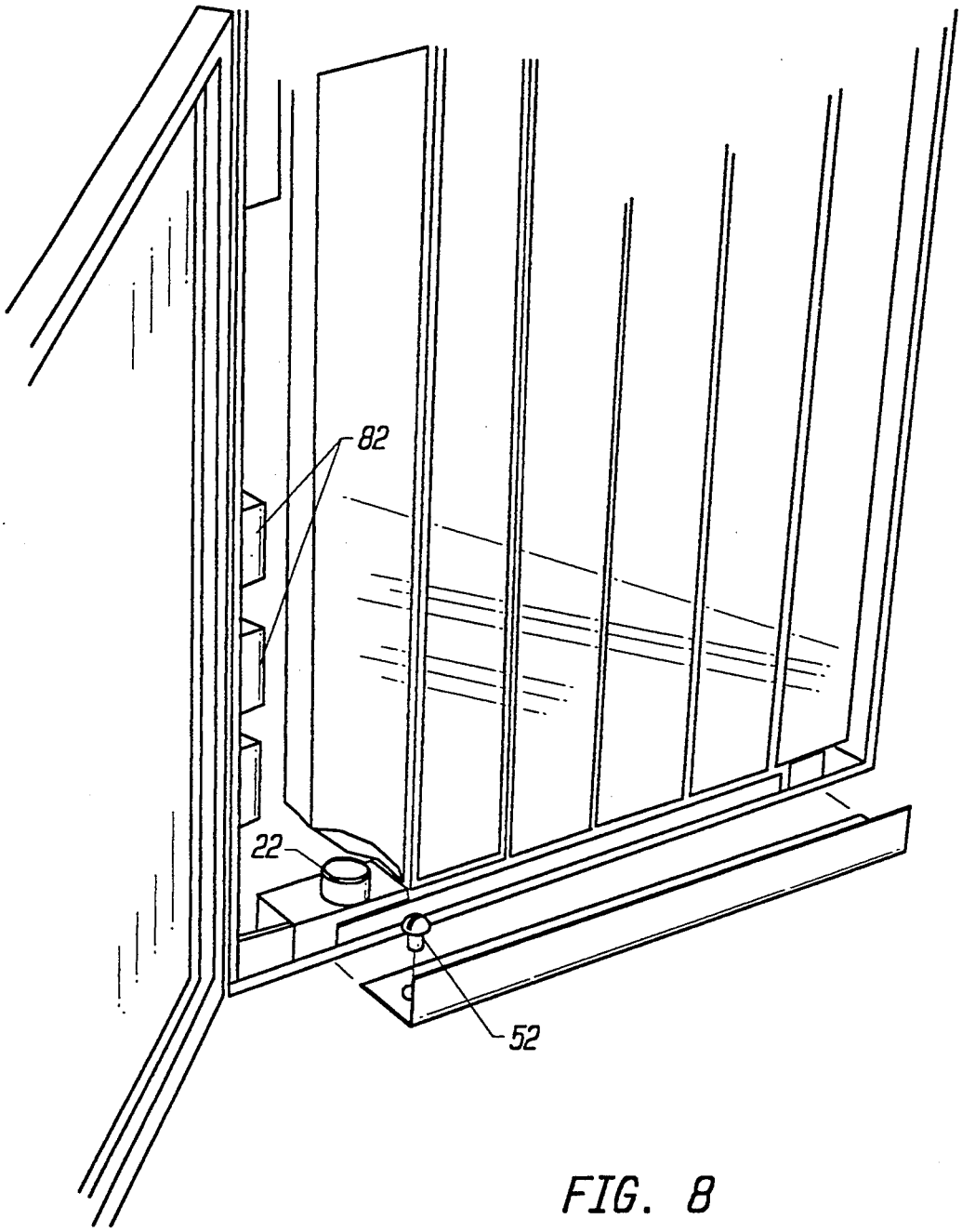
FIG. 8 is a perspective view of an alternative embodiment for mounting and accessing the lamp assemblies used in the display apparatus.

FIG. 8 shows an alternative method for mounting the light source lamps 52. A sliding tray 80 for mounting all six or seven lamps 52 (only one of which is shown in FIG. 8) in individual lamp sprockets. Three electrical ballasts 82 are shown which convert an AC input voltage to the 12 v DC necessary for lamps 52. Also shown in FIG. 8 is a cover door 84, shown in an open position, mounted on hinges (not shown).

The many features and advantages of the present invention will be readily apparent to those of average skill in the art. These advantages and features are intended to be within the context of the invention as defined by the instant specification, including the detailed description, the drawings and the following claims.

We claim:

1. A display apparatus, comprising:

a housing having a top member, bottom member, and first and second side members;

a plurality of triangular display elements, the display elements having first, second and third major sides, suspended for rotation about a plurality of axes, the axes arranged in a plane, the first, second and third major sides each having a first and second edge, and a first and second end, the first edge including a first lip member and the second edge including a second lip member extending from said second edge in an opposing relationship with respect to the first lip member for inserting a display segment thereinbetween;

a vertical blind track for suspending the plurality of display elements at the first ends thereof;

a motor coupled to the vertical blind track for powering rotation of the display elements; and a plurality of light sources, one of said plurality of light sources being associated with each of said plurality of display elements and being mounted in said bottom member of said housing below the second end of each of said elements.

2. The apparatus of claim 1 wherein the housing is comprised of extruded aluminum.

3. The apparatus of claim 1 wherein the housing is comprised of pressboard.

4. The apparatus of claim 1 wherein the first and second lip members of the respective first and second edges comprise opposing L-shaped flanges for receiving the display segment.

5. The apparatus of claim 1 wherein each of said plurality of light sources includes an upwardly facing lamp directing a light beam into the display elements.

6. The apparatus of claim 5 wherein each of the light sources comprises a halogen spot lamp generating a beam of light having an intensity, the lamp positioned in the housing adjacent to the second end of the display element such that the intensity of the beam is centered between the first, second and third major sides of the display element.

7. The apparatus of claim 5 wherein each of the elements includes a reflector positioned in the first end of the element opposite the lamps.

8. The apparatus of claim 1 wherein each of the major sides couples another of the major sides through means of a snap-fit coupling.

9. The apparatus of claim 8 wherein the snap-fit coupling comprises a beaded segment at the first edge of each side and a retainer at the second edge of each side.

10. An apparatus, comprising:

a housing including a frame comprising a top, bottom, and first and second sides;

a plurality of rotatable display elements, each of the display elements having a base and a top, and comprising three side members, each side member having a first and second edge, the first edge of a given member adapted to engage a second edge of a respective adjacent member;

means for supporting and rotating the display elements in a suspension fashion from the top of the display elements; and a plurality of spot-light sources, one of the plurality of sources associated with one of the plurality of display elements and positioned in the bottom of the housing below the base of the display elements directing illumination through the base of the display element toward the top of the display element.

11. The apparatus of claim 10 wherein the spot-light sources are halogen lamps.

12. The apparatus of claim 10 wherein each of said sources is mounted in a tube, the tube is positioned in the bottom of the housing, and a portion of the base of the display element is provided over the tube such that the element rotates about the tube.

13. The apparatus of claim 12 wherein a bore in the housing is provided adjacent each of the sources.

14. The apparatus of claim 10 wherein each of the elements includes reflective means positioned at the top of the element.

15. The apparatus of claim 14 wherein the reflective means comprises a top cap manufactured from white plastic secured to the element.

16. A display system, comprising:

a frame having a top member, bottom member, and first and second side members separating the top and bottom members;

a plurality of display members, each of the plurality of display members including multiple sides and a top and a bottom, each of the sides including a first and second edge, each first edge on one of the sides being adapted to form an interlocking fit with a respective second edge on another of the sides;

means for suspending the display members and rotating the display members such that respective ones of the sides of the display members forms display plane at a given moment in time; and means for illuminating each of the plurality of display members, the means for illuminating being positioned in the bottom member of the frame below the display members and directing a light upward toward the top of said display members.

17. An apparatus, comprising:

a housing having a top, bottom, a first side and a second side;

a display element drive track mounted in the top of the housing, the drive track having a plurality of rotatable gear elements;

a plurality of triangular display elements having a first end and a second end, each of the plurality of elements being coupled to the respective gear elements at the first end, each display element comprised of a first, second and third side; and means for illuminating the display elements, the means being positioned in the bottom of the housing below the second end and directing illumination toward the top of the display elements.

* * * * *